US011377255B2

(12) United States Patent
Wainless et al.

(10) Patent No.: US 11,377,255 B2
(45) Date of Patent: Jul. 5, 2022

(54) PACKAGED SET OF ARTICLES AND METHOD OF LOADING PACKAGES ONTO A SUPPORT MEMBER

(71) Applicant: Colgate-Palmolive Company, New York, NY (US)

(72) Inventors: Daniel Wainless, New Brunswick, NJ (US); Eduardo Jimenez, Manalapan, NJ (US); Quang Nguyen, Hillsborough, NJ (US); Yixin Keller, New York, NY (US); Aaron Quattlebaum, Fayetteville, AR (US); Jacalyn O'Keefe, Hoboken, NJ (US); Lindsey Buckheit, New York, NY (US); Patrick Diberardino, New York, NY (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 17/040,589

(22) PCT Filed: Apr. 8, 2019

(86) PCT No.: PCT/US2019/026303
§ 371 (c)(1),
(2) Date: Sep. 23, 2020

(87) PCT Pub. No.: WO2019/199658
PCT Pub. Date: Oct. 17, 2019

(65) Prior Publication Data

US 2021/0070496 A1 Mar. 11, 2021

Related U.S. Application Data

(60) Provisional application No. 62/654,829, filed on Apr. 9, 2018.

(51) Int. Cl.
*B65D 83/00* (2006.01)
*B65D 5/54* (2006.01)
*B65D 5/52* (2006.01)

(52) U.S. Cl.
CPC ..... *B65D 5/5445* (2013.01); *B65D 5/542* (2013.01); *B65D 5/52* (2013.01); *B65D 83/0088* (2013.01)

(58) Field of Classification Search
CPC ..... B65D 5/52; B65D 5/542; B65D 5/5445; B65D 83/0088
(Continued)

(56) References Cited

U.S. PATENT DOCUMENTS 3,313,407 A * 4/1967 Palm, Jr. ..... B65D 5/5021 206/526
3,721,339 A * 3/1973 Seyer ..... B65D 83/0088 206/557
(Continued)

FOREIGN PATENT DOCUMENTS

GB 2263691 5/1995
NL 2018035 6/2018
(Continued)

OTHER PUBLICATIONS

International Search Report and the Written Opinion of the International Searching Authority issued in International Application PCT/US2019/026303 dated Jun. 6, 2019.

*Primary Examiner* — King M Chu

(57) ABSTRACT

A packaged set of articles that are easily mounted to a pegboard hook. The packaged set of articles includes a container having a base portion and a top portion that are separable from one another along a pre-weakened line. The top portion includes a portion of a front wall of the container and a portion of a rear wall of the container. The top portion may include at least 50%, or at least 75%, or the entirety of
(Continued)

the rear wall of the container. A plurality of packages, each of which contains an article, is arranged in an internal cavity of the container in single file. The packages may include an aperture so that the packages can be hung from a pegboard hook in a retail display. The hanging apertures may be aligned so that an employee can use the container to slide the packages onto the pegboard hook.

29 Claims, 14 Drawing Sheets

(58) Field of Classification Search
USPC ..... 206/737
See application file for complete search history.

(56) References Cited

U.S. PATENT DOCUMENTS 5,730,296 A * 3/1998 Limmer ..... B65D 83/0088 206/738
6,446,819 B1 9/2002 Mattesky
6,726,428 B1 4/2004 Canepari
7,028,376 B2 4/2006 Mattesky
8,261,909 B2 9/2012 Sorrentino et al.
2003/0213722 A1* 11/2003 Kinigakis ..... B65D 5/548 206/541
2005/0061756 A1 3/2005 Mattesky
2009/0294309 A1* 12/2009 Franco ..... B65D 67/02 206/223
2012/0325703 A1 12/2012 Sorrentino et al.
2014/0083885 A1* 3/2014 Lee ..... B65D 75/366 206/361
2016/0207683 A1* 7/2016 Moskovich ..... B65D 75/54

FOREIGN PATENT DOCUMENTS

NL 2018035 B1 * 6/2018 ..... B65D 5/5445
WO WO-9708061 A1 * 3/1997 ..... B65D 5/5445
WO 2012/145515 10/2012
WO 2017/023507 2/2017

* cited by examiner

PACKAGED SET OF ARTICLES AND METHOD OF LOADING PACKAGES ONTO A SUPPORT MEMBER

CROSS-REFERENCE TO RELATED APPLICATION

This application claims priority to U.S. Provisional Patent Application No. 62/654,829, filed on Apr. 9, 2018, the entirety of which is incorporated by reference herein.

BACKGROUND

Articles are packaged in display packaging (such as blister packs or the like) that are placed within secondary containers that are placed within primary containers during transport of those articles from a manufacturing facility to a retail facility. It is time-consuming for an employee at the retail facility to unpack each of the display packages from the primary and secondary containers and to then load the display packages onto a display peg hook. Thus, a need exists for a device, product, or technique to speed up the process of loading the display packages onto display peg hooks in a retail facility.

BRIEF SUMMARY

The present invention is directed to a packaged set of articles. The packaged set of articles includes a container having a base portion and a top portion that are separable from one another along a pre-weakened line. The top portion includes a portion of a front wall of the container and a portion of a rear wall of the container. The top portion may include at least 50%, or at least 75%, or the entirety of the rear wall of the container. A plurality of packages, each of which contains an article, is located in an internal cavity of the container. The packages may be arranged in single file. The packages may include a hanging aperture so that the packages can be hung from a pegboard hook in a retail display. When in the containers, the hanging apertures may be aligned so that an employee can use the container, with the top portion removed from the base portion, to slide the packages onto the pegboard hook.

In one aspect, the invention may be a packaged set of articles comprising: a container comprising a bottom end, a top end, a front wall, a rear wall, a first-sidewall, and a second sidewall, each of the front wall, the rear wall, the first-sidewall, and the second-sidewall having a height measured between the bottom end and the top end; the container defining an internal cavity and comprising a base portion and a top portion that are coupled together by a pre-weakened line, the base portion and the top portion being separable from one another along the pre-weakened line; the top portion of the container comprising a first portion of the front wall and a first portion of the rear wall, the first portion of the front wall having a first height and the first portion of the rear wall having a second height, the second height being greater than the first height; and a plurality of packages located in the internal cavity of the container, each of the packages comprising a receiving cavity; and an article disposed within the receiving cavity of each of the packages.

In another aspect, the invention may be a packaged set of articles comprising: a container comprising a bottom end, a top end, a front wall, and a rear wall; the container defining an internal cavity and comprising a base portion and a top portion that are coupled together by a pre-weakened line, the base portion and the top portion being separable from one another along the pre-weakened line; the top portion of the container comprising the top end and a first portion of the rear wall; a plurality of packages located in the internal cavity of the container so that a display side of the package is facing the front wall of the container, each of the packages comprising a receiving cavity; and an article disposed within the receiving cavity of each of the packages.

In yet another aspect, the invention may be a method of loading packages onto a support member for retail display, the method comprising: a) tearing a container along a pre-weakened line to at least partially detach a top portion of the container from a base portion of the container, the base portion of the container defining a holding cavity within which a plurality of packages are located, each of the packages containing an article; b) while the packages remain positioned in the holding cavity, placing the base portion of the container adjacent to the support member so that a hanging aperture of the packages is aligned with a distal end of the support member; c) moving the base portion of the container in a first direction so that the support member extends through the hanging apertures of each of the packages to support the packages; and d) moving the base portion of the container in a second direction opposite the first direction; thereby removing the packages from the holding cavity and leaving the packages hanging from the support member.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
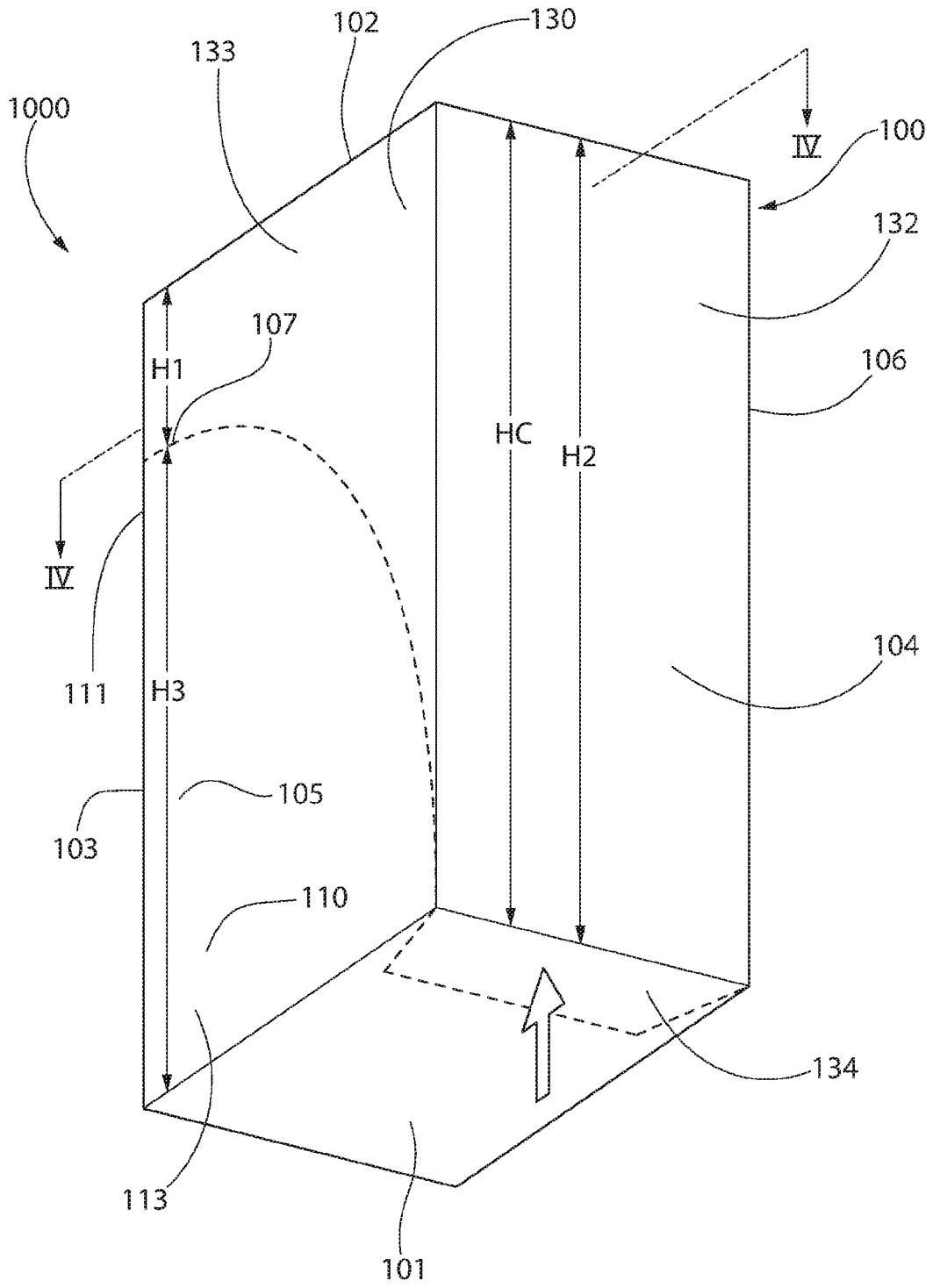
FIG. 1 is a perspective view of a container for holding packages containing articles in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
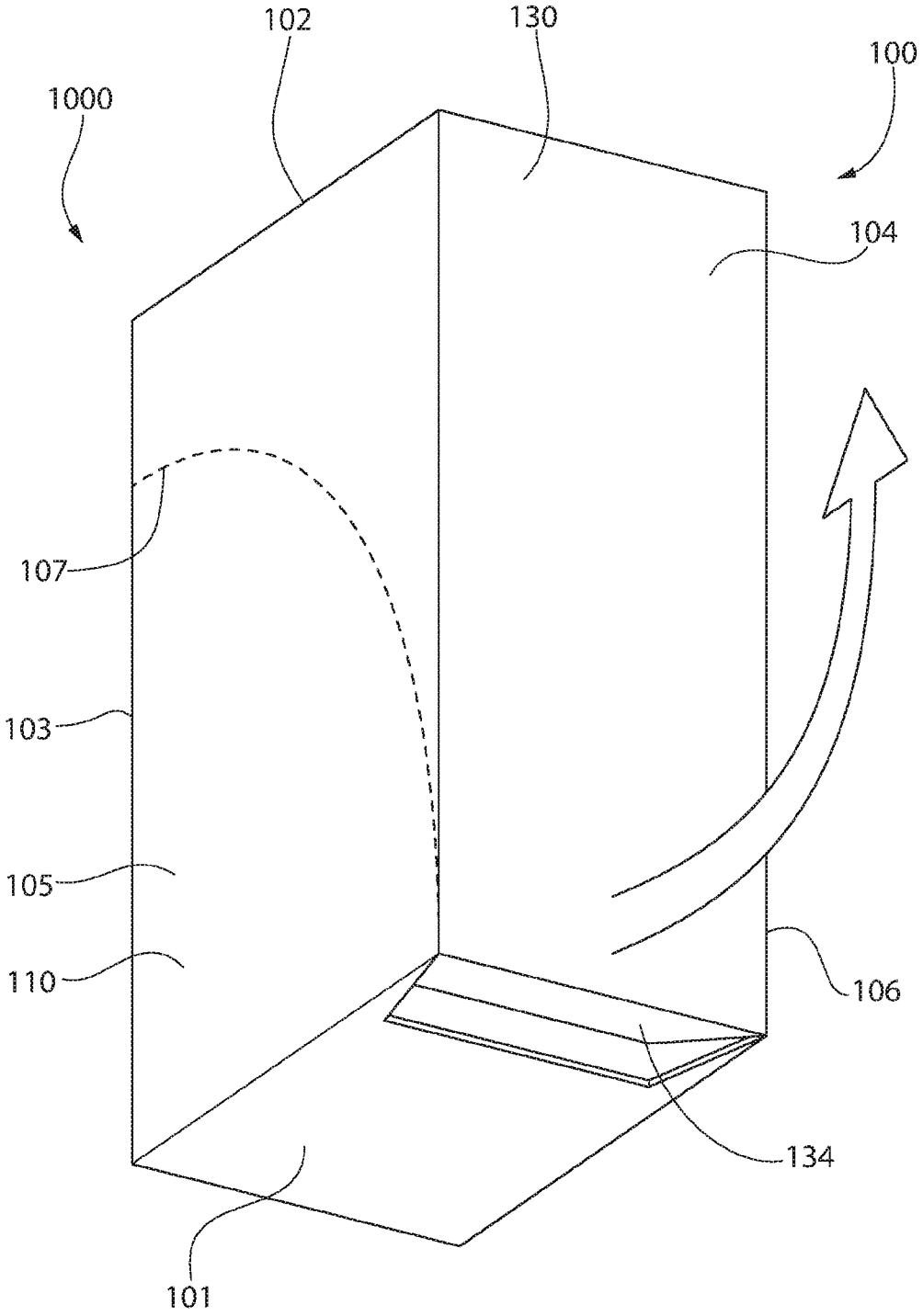
FIG. 2 is a perspective view of the container of FIG. 1 illustrating a top portion of the container being separated from a base portion of the container.
Figure 3:
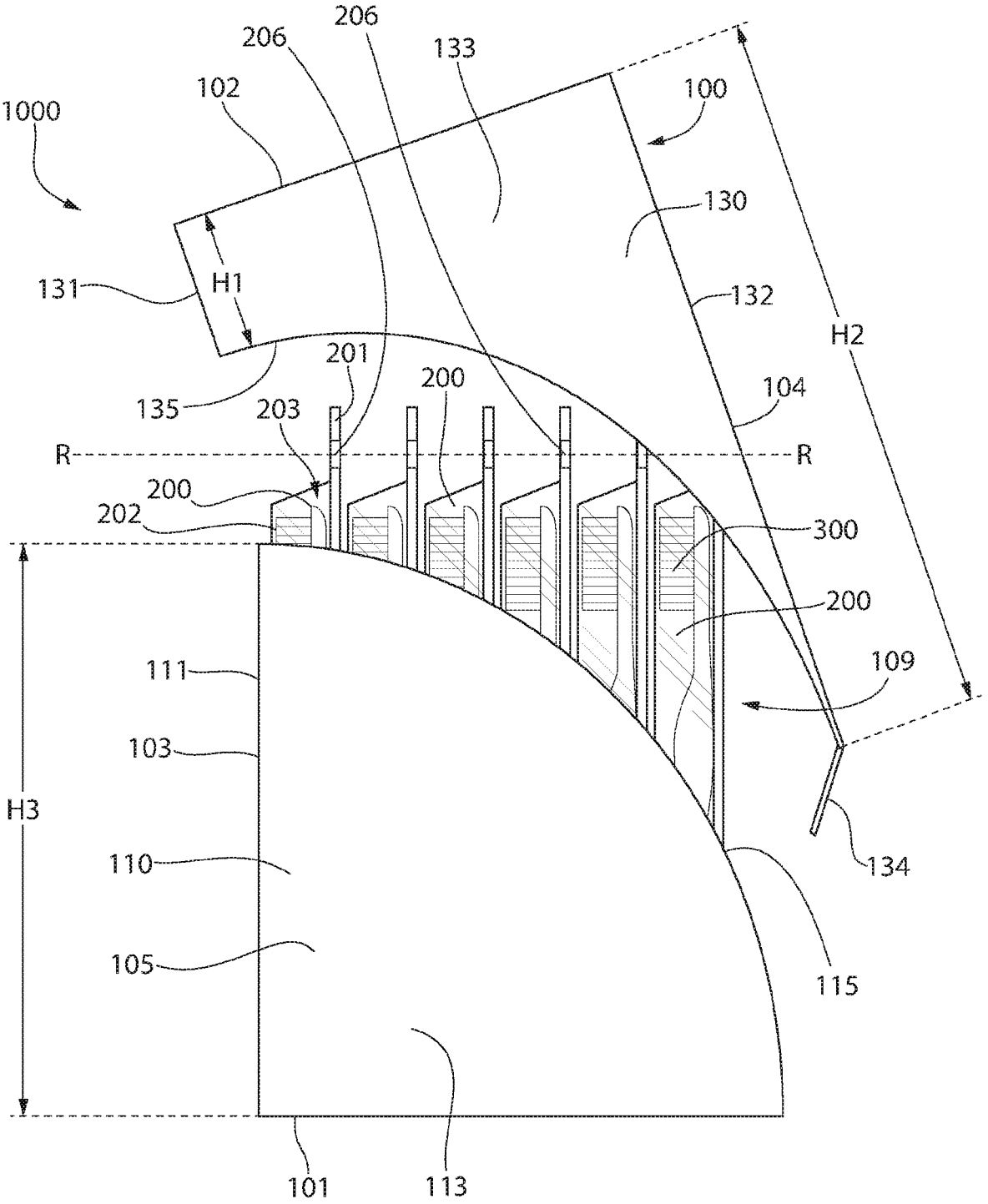
FIG. 3 is a side view of the container of FIG. 1 illustrating the container in an open state with the top portion of the container completely separated from the base portion of the container to expose a plurality of packages containing articles that are located within the container.

Referring to FIGS. 1-3 a packaged set of articles 1000 is illustrated in accordance with an embodiment of the present invention. The packaged set of articles 1000 generally comprises a container 100, a plurality of packages 200 located in the container 100, and an article 300 disposed within each of the packages 200. The packaged set of articles 1000 is advantageous in that a portion of the container 100 can be used to hold the packages 200 containing the articles 300 and to slide the packages 200 containing the articles 300 onto a pegboard hook in a retail display environment. Thus, rather than having an employee or other person remove each package 200 from the container 100 separately, the employee or other person can slide all of the packages 200 onto the pegboard hook simultaneously without ever having to remove the packages 200 from the container 100. Once the packages 200 are hanging from the pegboard hook, the portion of the container 100 can be pulled away from the packages 200, thereby leaving the packages 200 hanging from the pegboard hook.

In the exemplified embodiment, the container 100 comprises a bottom end 101, a top end. 102, a front wall 103, a rear wall 104, a first sidewall 105, and a second sidewall 106. Thus, in the exemplified embodiment the container 100 has a rectangular shape. However, the invention is not to be so limited in all embodiments and the container 100 can take on other shapes in other embodiments as should be appreciated by persons skilled in the art. The container 100 may be formed of a cardboard material in some embodiments, or it may be formed of other materials such as plastic or the like so long as it is capable of being used in accordance with the teachings set forth herein. Each of the front wall 103, the rear wall 104, the first sidewall 105, and the second sidewall 106 has a height HC measured from the bottom end 101 to the top end 102. In the exemplified embodiment the height HC is the same for each of the front wall 103, the rear wall 104, the first sidewall 105, and the second sidewall 106. However, this is not required in all embodiments.

The container comprises a base portion 110 and a top portion 130. The base portion 110 and the top portion 130 are coupled together by a pre-weakened line 107. In the exemplified embodiment, the pre-weakened line 107 is a perforation line, which is a line formed by a series of spaced apart cuts, perforations, holes, or apertures that are formed into the container 100. However, the pre-weakened line 107 may be a fold line, a depression, an indentation, a score line, or the like that facilitates tearing of the container 100 along the pre-weakened line 107 to separate the top portion 130 from the base portion 110. Thus, the pre-weakened line 107 makes it easy to tear the container 100 therealong and creates a smooth, even tear so that the edges of the base and top portions 110, 130 of the container 100 are smooth even after separation.

In the exemplified embodiment, the top portion 130 of the container 100 comprises a first portion 131 of the front wall 103, a first portion 132 of the rear wall 104, a first portion 133 of the first sidewall 105, and a first portion of the second sidewall 106 (not visible in the figures provided, but identical to the first portion 133 of the first sidewall 105). The top portion 130 comprises an entirety of the top end 102 of the container 100. The top portion 130 also comprises a tab portion 134 that forms a portion of the bottom end 101 of the container 100.

When the top portion 130 of the container 100 is separated from the base portion 110 of the container 100, the top portion 130 of the container 100 has a lower edge 135. The first portion 131 of the front wall 103 has a first height H1 measured from the lower edge 135 (or from the pre-weakened line 107) to the top end 102 of the container 100. The first portion 132 of the rear wall 104 has a second height H2 measured from the lower edge 135 (or from the pre-weakened line 107) to the top end 102 of the container 100. In the exemplified embodiment, the second height H2 is greater than the first height H1.

The first portion 133 of the first sidewall 105 and the first portion of the second sidewall 106 terminate in the lower edge 135 as noted above. In the exemplified embodiment, the lower edge 135 is concave such that a height of the first portions 133 of the first and second sidewalls 105, 106 measured from the top end 102 of the container 100 to the lower edge 135 of the top portion 130 continuously increases with increasing distance from the front wall 103 towards the rea4 wait 104.

The base portion 110 of the container 100 comprises an upper edge 115 when separated from the top portion 130. The base portion 110 of the container 100 comprises a second portion 111 of the front wall 103, a second portion 113 of the first sidewall 105, and a second portion of the second sidewall 106 (not visible in the exemplified embodiment, but identical to the second portion 113 of the first sidewall 105). The second portion 111 of the front wall 103 has a third height H3.

In the exemplified embodiment, the first portion 132 of the rear wall 104 that forms a part of the top portion 130 of the container 100 forms the entirety of the rear wall 104 of the container 100. Thus, in the exemplified embodiment the base portion 110 does not form any of the rear wall 104 of the container 100. Thus, in the exemplified embodiment the height H2 of the first portion 132 of the rear wall 104 is equal to the height HC of the rear wall 104 of the container 100. However, the invention is not to be so limited in all embodiments and in other embodiments it is possible that the base portion 110 of the container 100 may include a portion of the rear wall 104 having a fourth height. However, it is preferable that the second height H2 of the first portion 132 of the rear wall 104 be at least 50%, more preferably at least 75%, more preferably at least 80%, more preferably at least 85%, and more preferably at least 90% of the height HC of the rear wall 104 with the fourth height of the portion of the rear wall 104 that is formed by the base portion 110 of the container 100 making up the rest of the height HC of the rear wall 104. The reason that it is preferable that a majority of the rear wall 104 be formed as a part of the top portion 130 of the container 100 will become clear from the description of FIGS. 6-10 below. In the exemplified embodiment, the fourth height is zero because the base portion 110 of the container 100 does not form any part of the rear wall 104 (but rather, the entirety of the rear wall 104 is formed by the top portion 130 of the container 100).

In the exemplified embodiment, the upper edge 115 of the base portion 110 of the container 100 is convex. Thus, the height of the second portion 113 of the first sidewall 105 and the height of the second portion of the second sidewall 106, measured between the bottom end 101 of the container 100 and the upper edge 115 of the base portion 110, continuously decreases with distance from the front wall 103 towards the rear wall 104.

In the exemplified embodiment, the third height H3 of the second portion 111 of the front wall 103 is greater than the first height H1 of the first portion 131 of the front wall 103. Specifically, in the exemplified embodiment the third height H3 is approximately 80% of the height HC of the front wall 103 and the first height H1 is approximately 20% of the height HC of the front wall 103. However, the invention is not to be so limited in all embodiments and the third height H3 may be between 40% and 90% of the height HC, more specifically between 50% and 80% of the height HC, or more specifically between 60% and 80% of the height HC of the front wall 103 while the first height H1 makes up the remainder of the height HC of the front wall 103. As will be described more fully below, when the top portion 130 is separated from the base portion 110, the articles remain located in a holding cavity of the base portion 110. Thus, maintaining the second portion 111 of the front wall 103 with a reasonably large height relative to the height HC of the front wall 103 assists in preventing the articles from falling out of the holding cavity of the base portion 110 prematurely. Specifically, the second portion 111 of the front wall 103 ensures that the packages 200 do not fall out of the base portion 110 of the container 100 when they are being loaded onto a pegboard hook.

Figure 4:
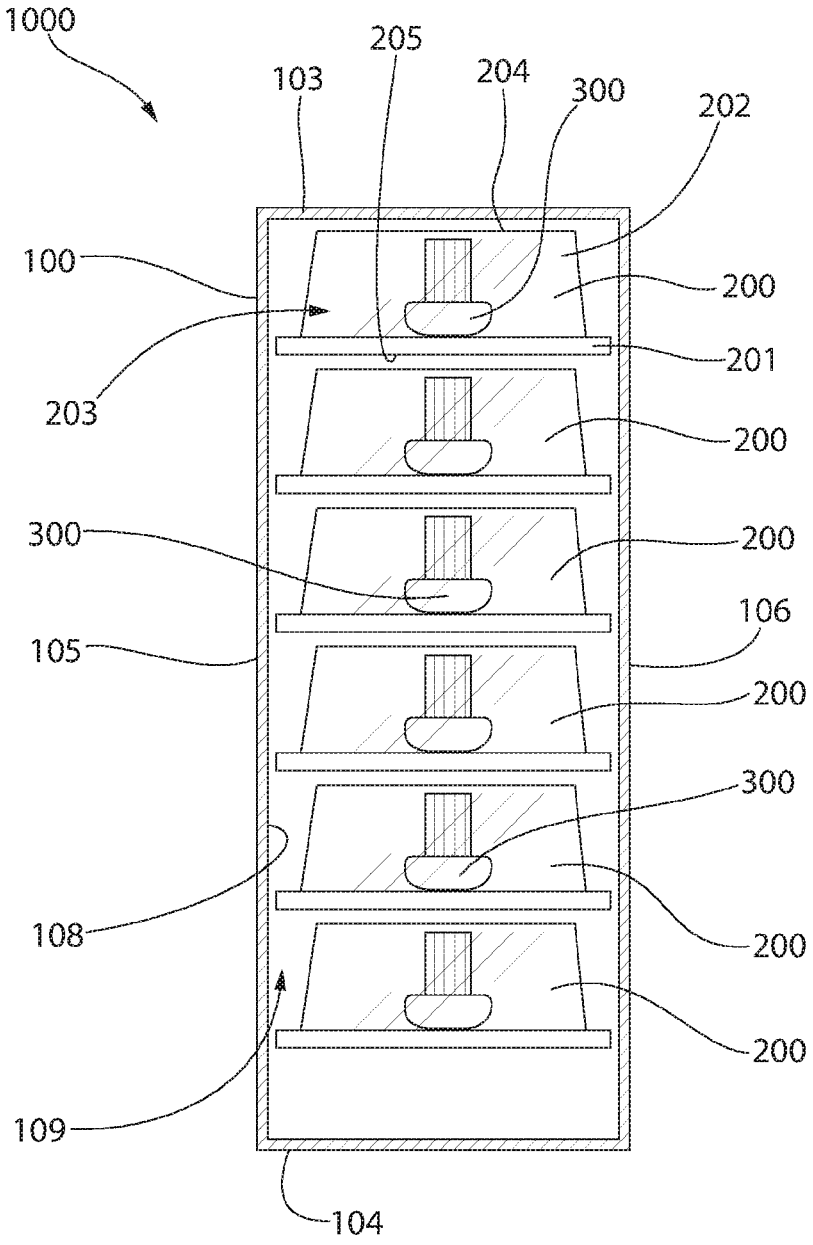
FIG. 4 is a cross-sectional view taken along line IV-IV in FIG. 1.

Referring to FIG. 4, the container 100 comprises an inner surface 108 that defines an internal cavity 109. The container 100 is alterable between a closed state, depicted in FIG. 1, and an open state, depicted in FIG. 3. In the closed state, the base portion 110 and the top portion 130 are coupled together and the internal cavity 109 of the container 100 is fully enclosed. In the open state, the top portion 130 is separated from the base portion 110 and the internal cavity 109 has at least one open end to enable articles to be loaded into and unloaded from the internal cavity 109.

In the exemplified embodiment, a plurality of the packages 200 are positioned within the internal cavity 109 of the container 100. The plurality of packages 200 are arranged in single file within the internal cavity 109. Thus, the plurality of packages 200 are arranged in a single row or line in a front-to-back manner. Thus, the back side of one of the packages 200 is adjacent to the front side of another one of the packages 200. Of course, the packages 200 could be arranged back-to-back and front-to-front in other embodiments if so desired.

In the exemplified embodiment, each of the plurality of packages 200 is a blister-style package comprising a backer panel 201 and a front cover 202 that is coupled to the backer panel 201 so that a receiving cavity 203 is formed between the front cover 202 and the backer panel 201. In the exemplified embodiment, the backer panel 201 is a flat panel formed of cardboard and the front cover 202 is a three-dimensionally contoured thermoformed plastic. The front cover 202 may be transparent or translucent in some embodiments. Each of the packages 200 has a display side (i.e., a front side) 204 and a non-display side (i.e., a rear side) 205. In the exemplified embodiment, the display side 204 of each of the packages 200 faces the front wall 103 of the container 100 and the non-display side 205 of each of the packages 200 faces the rear wall 104 of the container 100. Thus, the front cover 202 extends from the backer panel 201 in a direction towards the front wall 103 of the container 100.

The display side 204 of the packages 200 may include desirable indicia, ornamentation, coloring, instructions, or the like that is desired to be visible to a consumer when the packages 200 are hanging from a pegboard hook or otherwise displayed in a retail environment. There may also be indicia, writing, instructions, or the like on the non-display side 205. However, the indicia on the display side 204 is the indicia that is desired to be displayed to a consumer to entice purchase of the article whereas the indicia on the non-display side 205 may include information more valuable to a consumer after purchase.

Still referring to FIG. 4, in the exemplified embodiment at least one article 300 is located within the receiving cavity 203 of each of the packages 200. In the exemplified embodiment, each of the articles 300 is a toothbrush. Furthermore, in the exemplified embodiment each of the toothbrushes are of the same style. What this means is that each of the toothbrushes contained within the container 100 have the same handle structure, bristle pattern, tongue cleaner pattern, and the like. The toothbrushes may have different colors, but they are the same type or style of toothbrush. This is important because all of the toothbrushes contained within the container 100 will eventually be hanging from the same pegboard hook in a retail store, and it is typically desirable for each of the items hanging from a single pegboard hook to be the same item (with possible differences in color or other ancillary features).

Although toothbrushes are used as the article 300 in the exemplified embodiment, the invention is not to be so limited in all embodiments. The article 300 may be any article that is typically displayed in a retail environment in its packaged form while hanging from a pegboard hook. Thus, the specific type of article used is not to be limiting of the present invention unless so specified in the claims.

Referring to FIGS. 3 and 4, each of the packages 200 comprises an aperture 206 to facilitate hanging of the package 200 from a pegboard hook as noted above. In the exemplified embodiment, the aperture 206 is formed into the backer panel 201 of the package 200. However, the invention is not to be so limited in all embodiments and the aperture 206 may be formed into a tab that is coupled to the backer panel 201 or the like. Moreover, in other embodiments the package 200 may not be a blister pack as shown in the exemplified embodiment. For example, the package 200 may merely be an enclosed box within which the article 300 is disposed. Either way, the package 200 will include an aperture or some other feature that permits hanging of the package 200 from a pegboard hook in a retail environment. As best seen in FIG. 3, with the packages 200 arranged in single file within the cavity 109 of the container 100, the apertures 206 of the packages 200 are all aligned with one another. Thus; a reference axis R-R exists that passes through the apertures 206 of each of the packages 200. In the exemplified embodiment, the reference axis R-R is parallel to the top and bottom ends 101, 102 of the container 100 and perpendicular to the front and rear walls 103, 104 of the container 100.

Referring again to FIGS. 1-3, the process of separating the top portion 130 from the base portion 130 will be described. To separate the top portion 130 from the base portion 110, a user pushes on the tab portion 134 of the top portion 130 relative to the remainder of the bottom end 101 of the container 100 so that the tab portion 134 tears along the pre-weakened line 107 and pivots inwardly (see FIGS. 1 and 2). Next, a user pulls on the top portion 130 relative to the base portion 110 as shown with the large arrow in FIG. 2. This causes the container 100 to separate at the pre-weakened line 107 until the top portion 130 is completely separated from the base portion 110, as shown in FIG. 3. The top portion 130 can then be discarded, recycled, or put to some other use.

Figure 5:
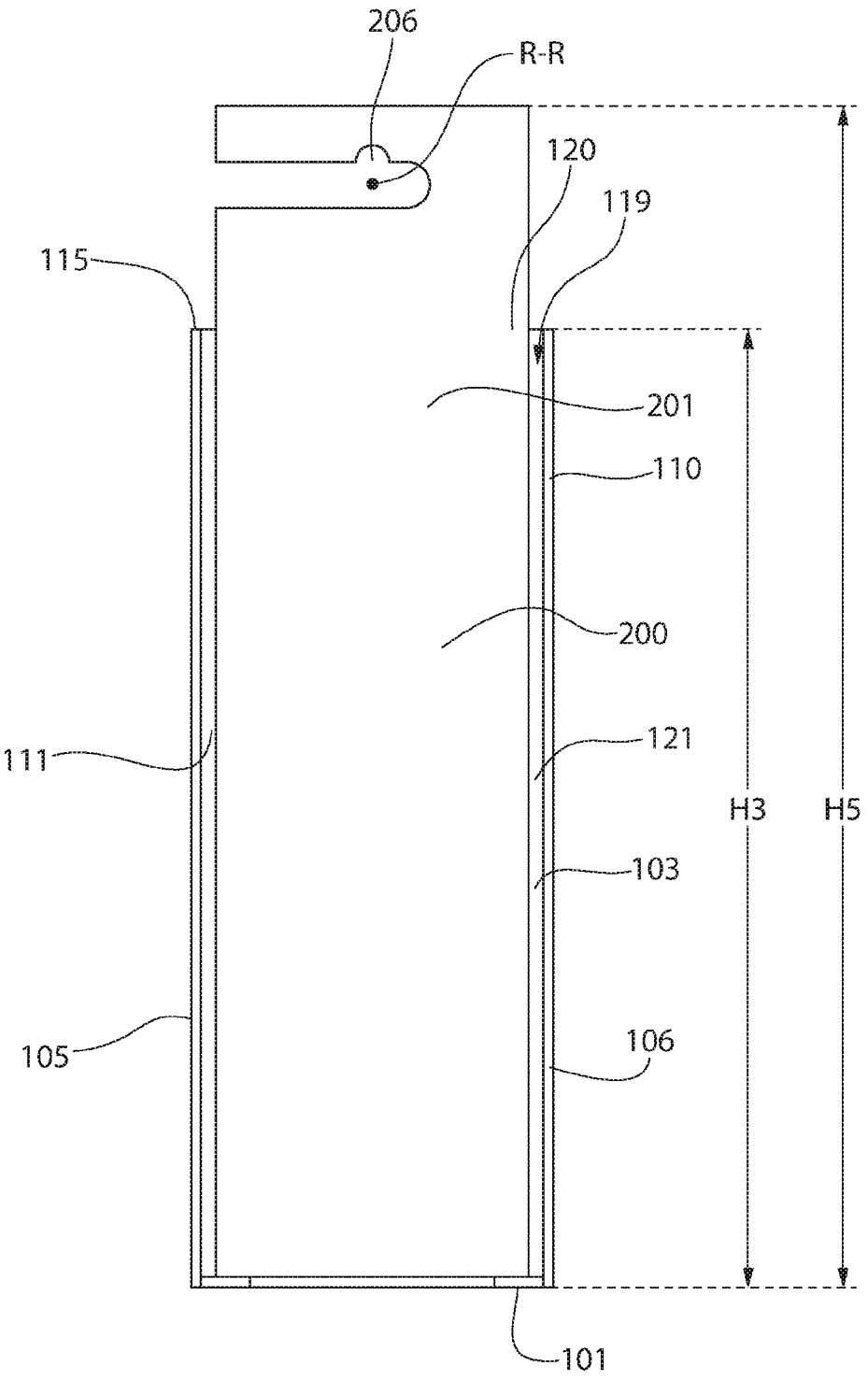
FIG. 5 is a rear view of the container of FIG. 1 in the open state.

Referring to FIGS. 3 and 5, when the top portion 130 is removed from the base portion 110, the base portion 110 defines a holding cavity 119, which is a portion of the internal cavity 109 of the container 100 that is defined by the base portion 110 of the container 100. The holding cavity 119 has an open top end 120 because the top portion 130 of the container 100 includes the entirety of the top end 102 of the container 100 and an open rear end 121 because the top portion 130 of the container 100 includes the entirety of the rear wall 104 of the container 100. Of course, even if the top portion 130 includes less than an entirety of the rear wall 104 as described herein, the rear end of the holding cavity 119 will still be open because a part of the rear wall 104 will be removed with the top portion 130.

When the top portion 130 is removed from the base portion 110, the packages 200 protrude from the upper edge 115 of the base portion 110. Specifically, the packages have a fifth height H5 that is greater than the third height H3 of the first portion 111 of the front wall 103. Furthermore, the apertures 206 in the packages 200 are elevated relative to the upper edge 115 of the base portion 110 so that they are accessible to a pegboard hook as described herein. This occurs because the apertures 206 are located at a top end of the packages 200. Thus, the packages 200 may be loaded onto a pegboard hook directly from the base portion 110 of the container 100 without first being removed from the holding cavity 119 of the base portion 110 of the container 100, Rather, removing the packages 200 (and articles 300) from the holding cavity 119 of the base portion 110 and loading the packages 200 (and articles 300) onto the pegboard hooks occurs simultaneously.

Figure 6:
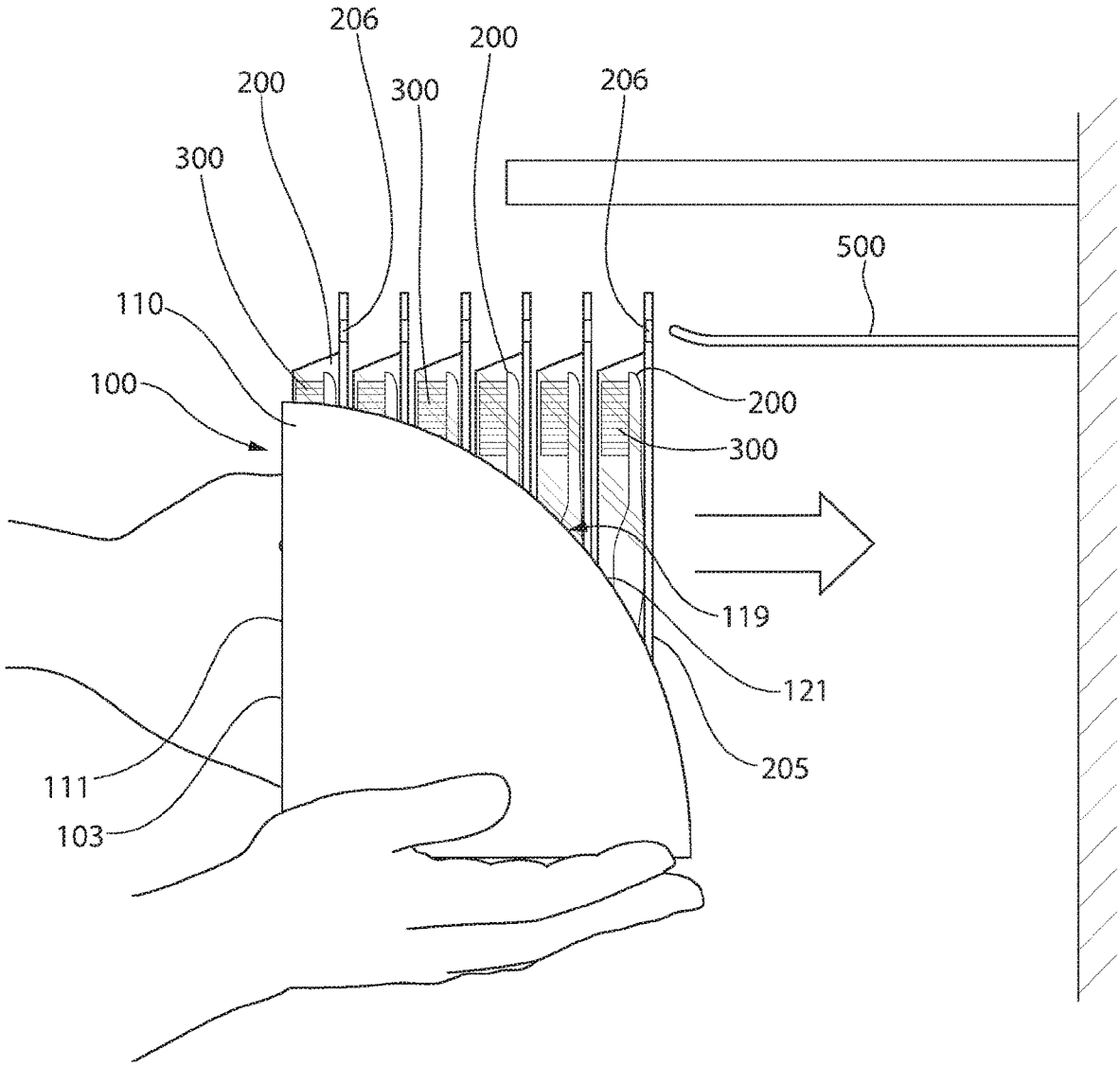
FIG. 6 is a side view illustrating a person holding the base portion of the container adjacent a pegboard hook with apertures of the packages that are located in the container aligned with the pegboard hook.

Referring to FIGS. 6-10 sequentially, the process of using the container 100, or the base portion 110 thereof, to load the packages 200 onto a pegboard hook 500 will be described. First, the top portion 130 of the container 100 is separated from the base portion 110 of the container 100 as described above with reference to FIGS. 1-3. The packages 200 containing the articles 300 remain located in the holding cavity 119 of the base portion 110 of the container 100, As shown in FIG. 6, the base portion 110 of the container 100 is brought near the pegboard hook 500 so that the apertures 206 of the packages 200 are in alignment with the pegboard hook 500. More specifically, the base portion 110 of the container 100 is moved adjacent to the pegboard hook 500 with the non-display sides (i.e., rear) 205 of the packages 200 and the open rear end 121 of the holding cavity 119 facing the pegboard hook 500 Because the packages 200 have a greater height than the base portion 110 of the container 100, the apertures 206 are located above the base portion 110 of the container 100 outside of the holding cavity 119.

Figure 7:
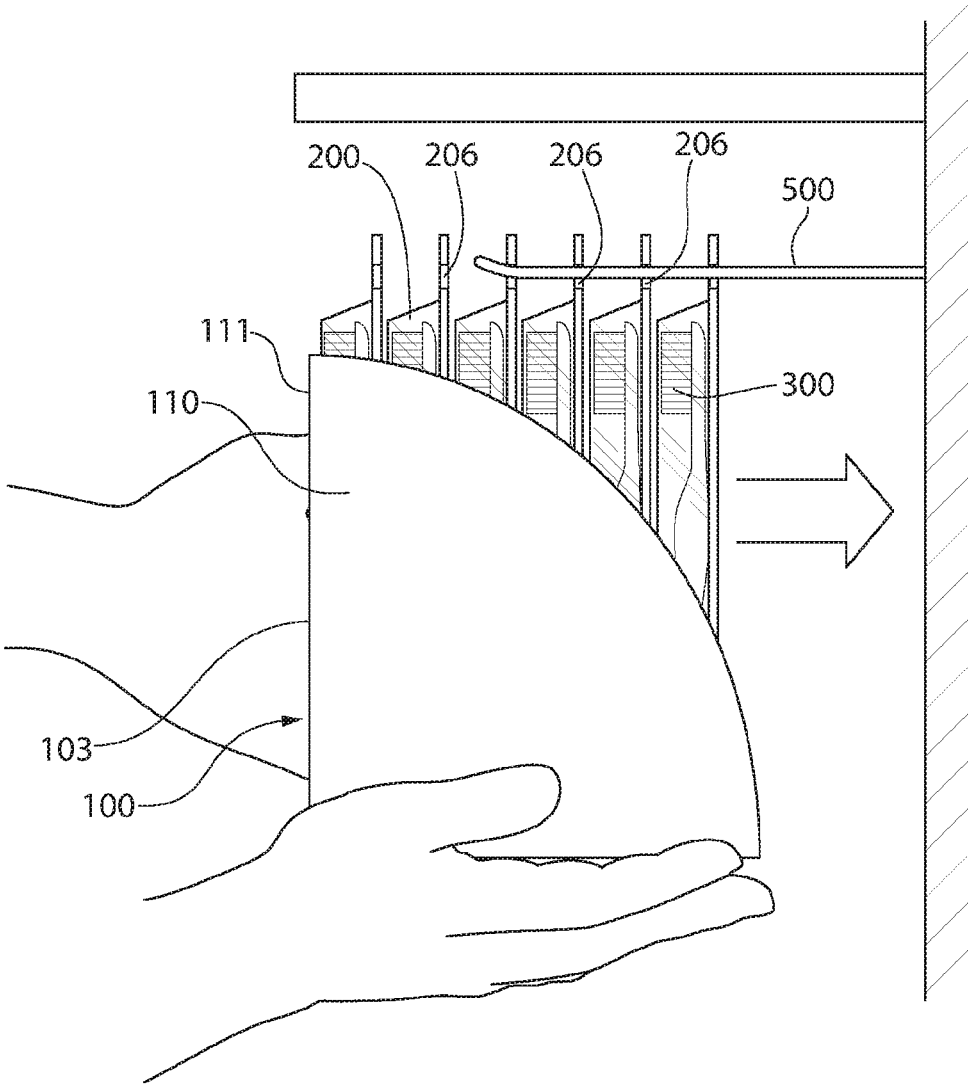
FIG. 7 is a side view illustrating a person holding the base portion of the container and sliding the packages onto the pegboard hook.
Figure 8:
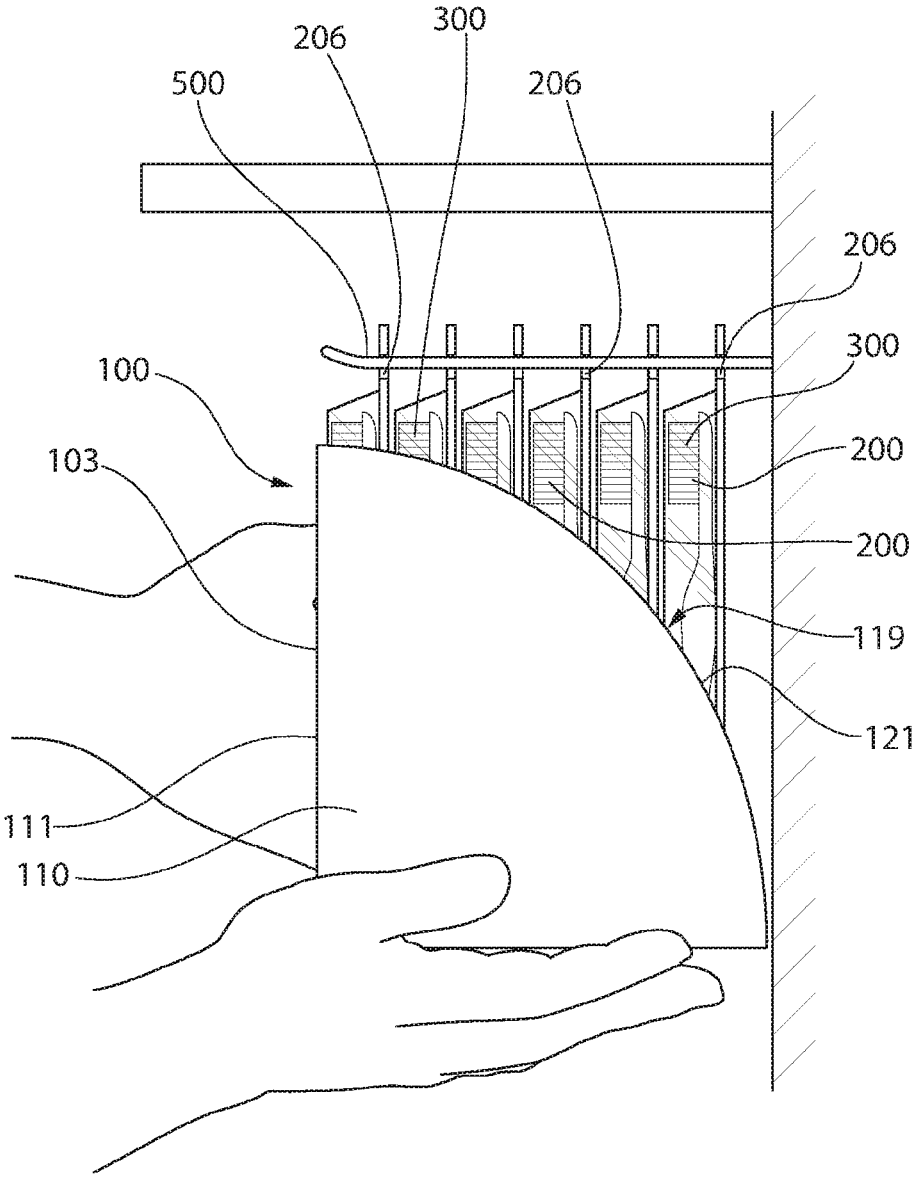
FIG. 8 is a side view illustrating a person holding the base portion of the container with all of the packages hanging from the pegboard hook.

Referring to FIG. 7, the base portion 110 of the container 100 has been moved/translated towards the pegboard hook 500 so that the pegboard hook 500 is extending through the apertures 206 of several of the packages 200. Continued sliding/translating of the base portion 110 of the container 100, as shown in FIG. 8, results in the pegboard hook 500 extending through the apertures 206 of all of the packages 200 held by the base portion 110 of the container 100. As the base portion 110 is moved to facilitate hanging of the packages 200 from the pegboard hook 500, it is possible that the front-most one of the packages 200 will abut against the second portion 111 of the front wall 103. Thus, the second portion 111 of the front wall 103 should have a sufficient height to ensure that the packages 200 do not fall out of the holding cavity 119 during the loading process.

At this point in time, the base portion 110 of the container 100 is no longer supporting the weight of any of the packages 200. Rather, the weight of the packages 200 is supported by the pegboard hook 500. Thus, the base portion 110 of the container 100 can be pulled, translated, or otherwise moved away from the pegboard hook 500. In some embodiments, the base portion 110 of the container 100 may first be moved downwardly just slightly to ensure that the packages 200 are no longer being supported by the base portion 110 of the container 100, and then the base portion 110 of the container 100 is translated or otherwise moved away from the pegboard hook 500.

Figure 9:
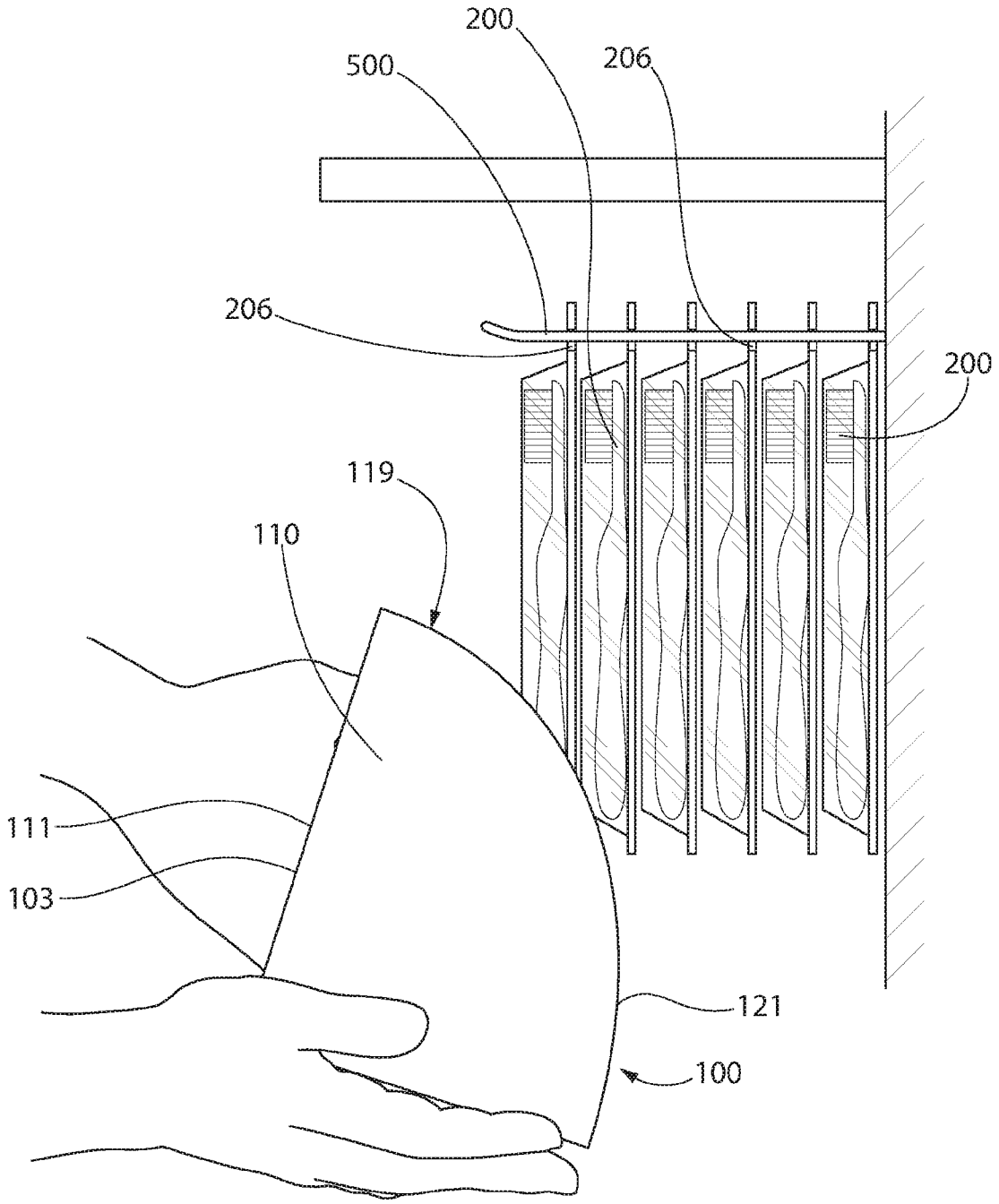
FIG. 9 is a side view illustrating a person pulling the base portion of the container away from the packages while the packages remain hanging from the pegboard hook.

In the exemplified embodiment, because the entirety of the rear wall 104 of the container 100 is removed when the top portion 130 is separated from the base portion 110, when the base portion 110 is moved away from the pegboard hook 500 as shown in FIG. 9, the packages 200 slide readily out of the holding cavity 119 via the open rear end 121. As mentioned above, in some embodiments it is possible that the base portion 110 of the container 100 may include a portion of the rear wall 104. In such an embodiment, the base portion 110 should be moved downwardly a sufficient amount so that the bottoms of the packages 200 are above the top edge of the portion of the rear wall 104 so that the packages 200 do not get caught or pulled by the rear wall 104 when the base portion 110 of the container 100 is being moved away from the pegboard hook 500. Having a minimal (or no) rear wall on the base portion 110 is ideal because in a retail environment there will be another pegboard hook directly below the bottoms of the packages 200 as they hang from the pegboard hook 500. Thus, there is a minimal amount of downward movement that can be achieved with the base portion 110 of the container 100 without bumping against that other pegboard hook.

Figure 10:
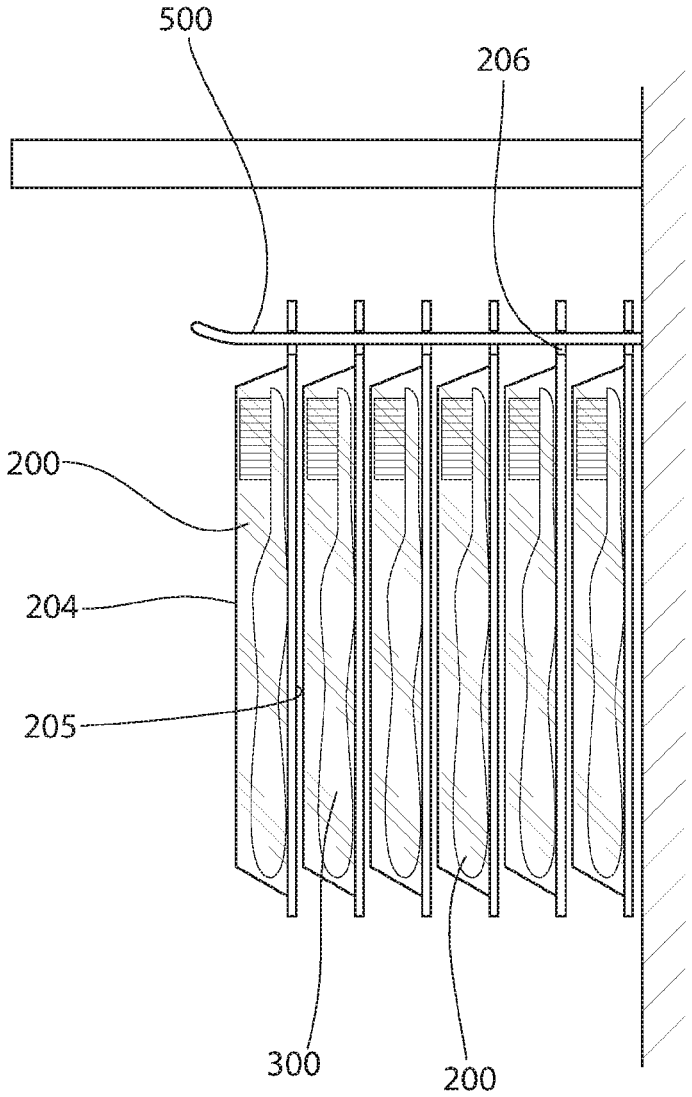
FIG. 10 is a side view illustrating the packages hanging from the pegboard hook.

FIG. 10 illustrates all of the packages 200 that were previously in the internal cavity 109 of the container 100 hanging from the pegboard hook 500. The packages 200 are slid from the container 100 onto the pegboard hook 500 using the base portion 110 of the container 100 in a single motion. Thus, this speeds up the process of moving packages from a shipping container into pegboard hooks in a retail environment. The display side 204 of each of the packages 200 faces outwardly towards a consumer and the non-display side 205 of each of the packages 200 faces away from a consumer. Thus, in the exemplified embodiment each of the packages 200 faces in the same direction. This may be desirable so that when one of the packages 200 is removed from the pegboard hook 500 for purchase by a consumer, the next package 200 in line will be facing the same direction to impart the same information to the next consumer. Of course, the packages 200 could be facing in different directions in other embodiments.

Figure 11A:
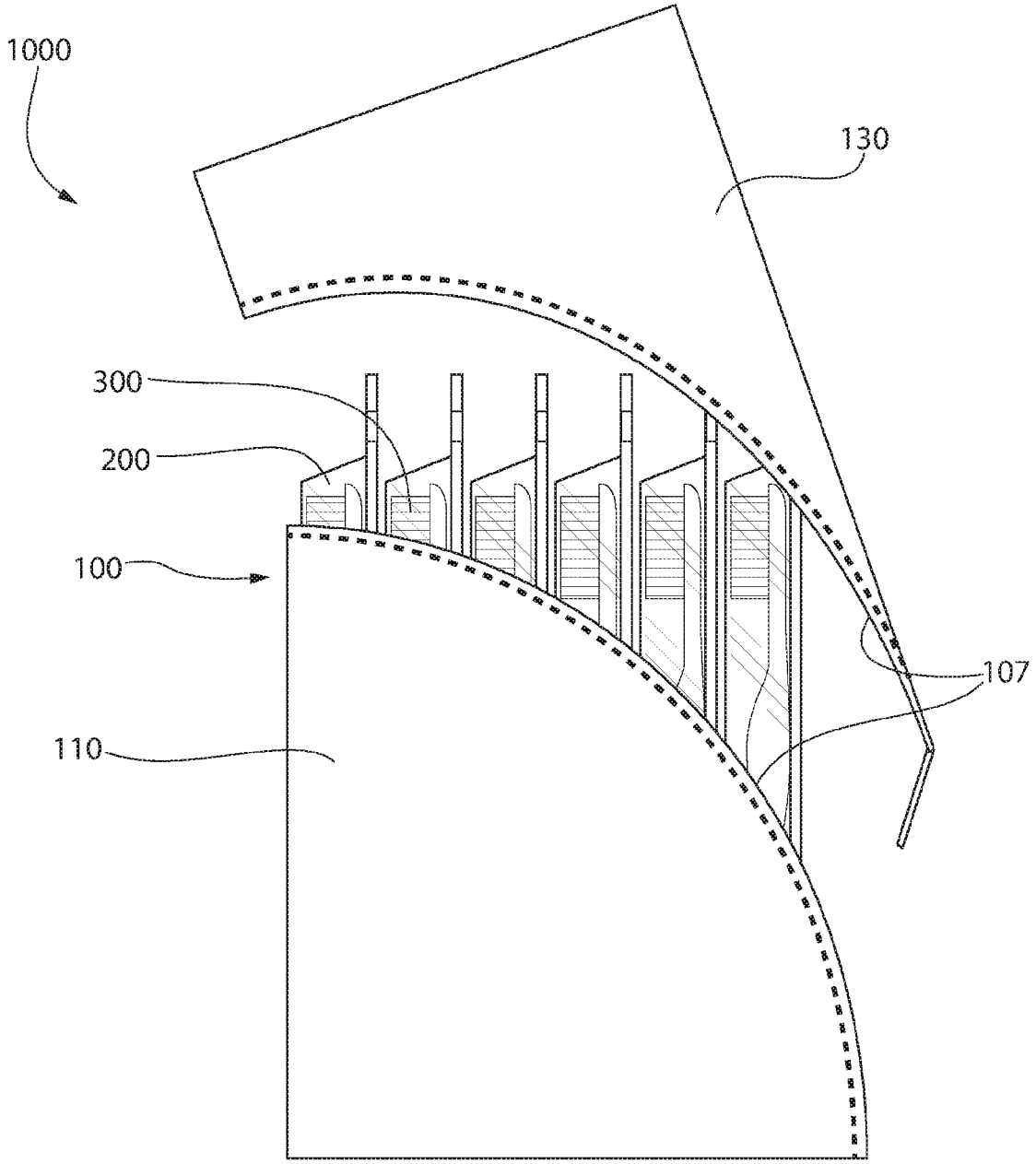
FIGS. 11A-11D illustrate the container of FIG. 1 with variations of indicia thereon.
Figure 11B:
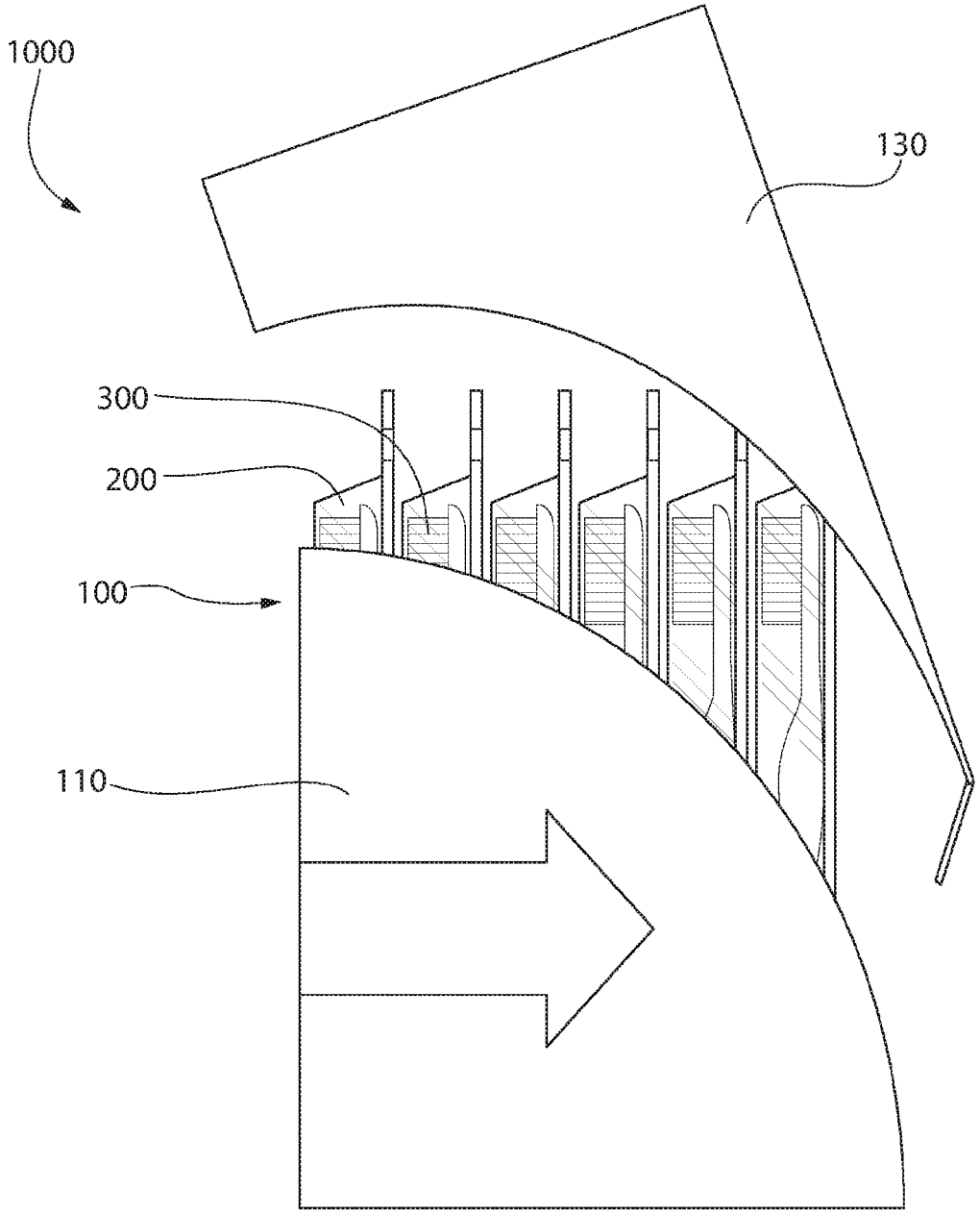
Figure 11C:
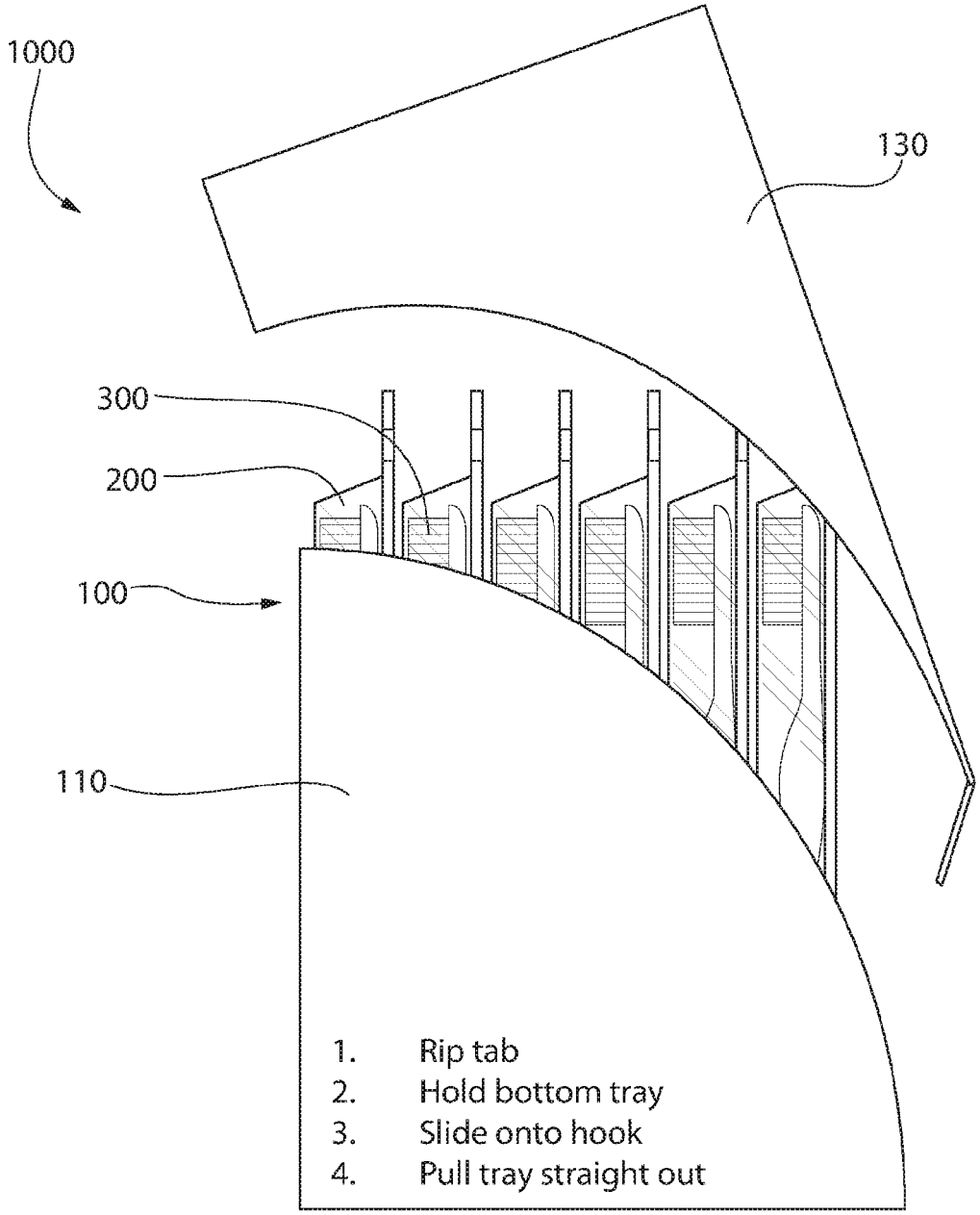
Figure 11D:
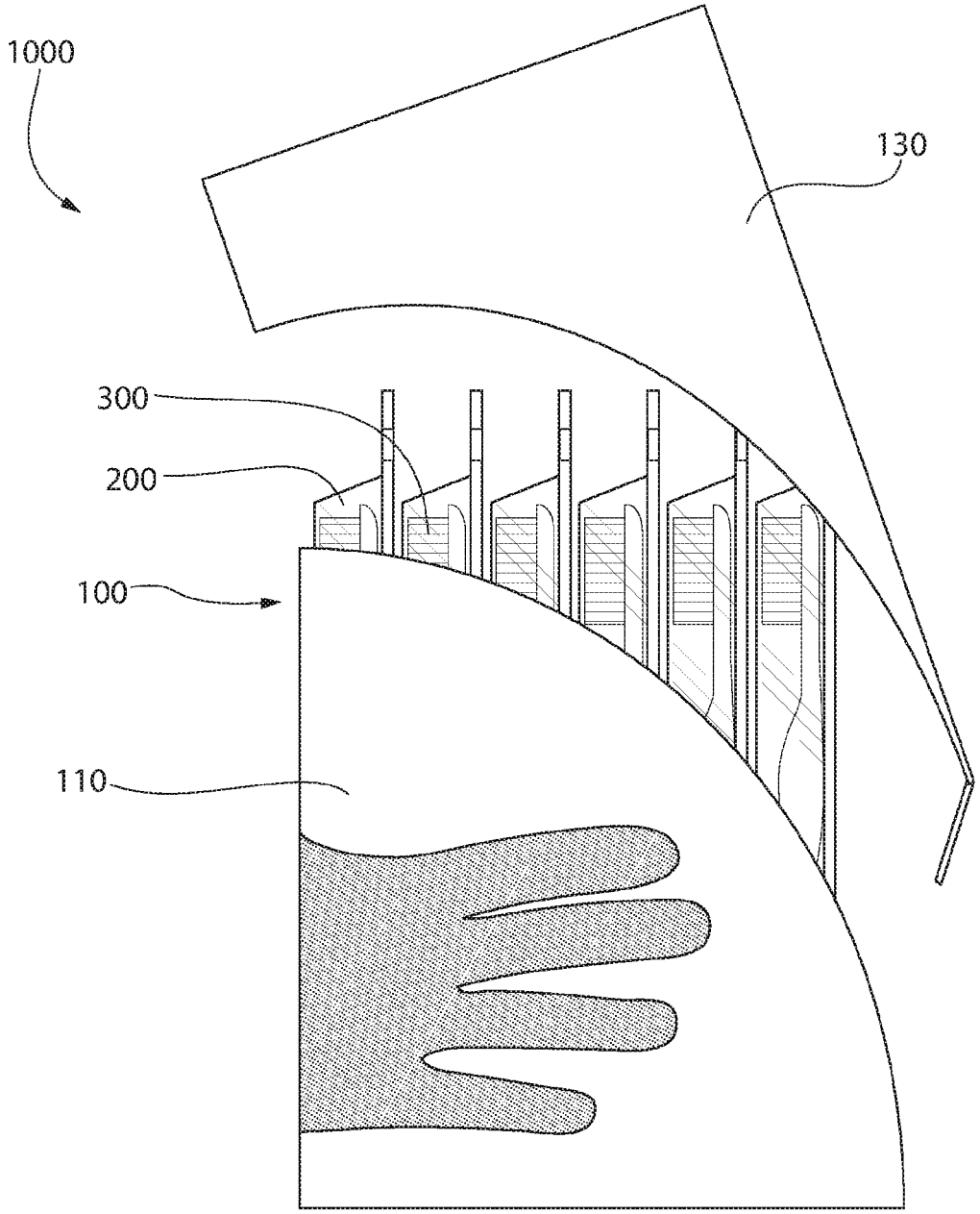

FIGS. 11A-11D illustrate the packaged set of articles 1000 as described herein above whereby the container 100 has various different indicia to assist a retail store employee or stock clerk in use of the container 100 as described herein. Specifically. FIG. 11A uses dashed lines on opposite sides of the pre-weakened line 107 to show how the top portion 130 can be separated from the base portion 110. FIG. 11B includes an arrow to illustrate the direction that the base portion 110 should be moved when loading the packages 200 onto the pegboard hook. FIG. 11C includes a listing of four steps required for use of the container 100 that amount to instructions regarding how to use the container 100 to load the packages 200 onto a pegboard hook. FIG. 11D includes an illustration of a hand to show a user where to place his/her hands during use of the container 100 to slide the packages 200 onto a pegboard hook. Thus, the container 100 may include printed graphical instructions, icons, or the like to inform the shelf stocker how to use the container 100. The container 100 may include any one of the indicia illustrated in FIGS. 11A-11D or any of various combinations thereof.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A packaged set of articles comprising:

a container comprising a bottom end, a top end, a front wall, a rear wall, a first sidewall, and a second sidewall, each of the front wall, the rear wall, the first sidewall, and the second sidewall having a height measured between the bottom end and the top end;

the container defining an internal cavity and comprising a base portion and a top portion that are coupled together by a pre-weakened line, the base portion and the top portion being separable from one another along the pre-weakened line;

the top portion of the container comprising a first portion of the front wall and a first portion of the rear wall, the first portion of the front wall having a first height and the first portion of the rear wall having a second height, the second height being greater than the first height; and a plurality of packages located in the internal cavity of the container, each of the packages comprising a receiving cavity; and an article disposed within the receiving cavity of each of the packages;

wherein the top portion of the container comprises an entirety of the top end of the container and a portion of the bottom end of the container and wherein the base portion of the container comprises a majority of the bottom end of the container; and wherein the top portion comprises a tab portion that forms a portion of the bottom end of the container.

2. The packaged set of articles according to claim 1, wherein the packages are arranged in the internal cavity of the container in single file.

3. The packaged set of articles according to claim 1, wherein each of the plurality of packages comprises a backer panel and a front cover that is coupled to the backer panel to form the receiving cavity between the front cover and the backer panel, and wherein for each of the packages, the front cover of the package is located closer to the front wall of the container than the backer panel of the package.

4. The packaged set of articles according to claim 3 wherein the backer panel of each of the packages is formed from cardboard and the front cover of each of the packages is formed from thermoformed plastic, and wherein the front cover is three-dimensionally contoured to form the receiving cavity between the front cover and the backer panel.

5. The packaged set of articles according to claim 1, wherein each of the packages comprises an aperture at a top end thereof for hanging the packages from a hook.

6. The packaged set of articles according to claim 5 wherein the packages are arranged in the internal cavity of the container so that the apertures of the packages are aligned.

7. The packaged set of articles according to claim 5 wherein the base portion of the container comprises a second portion of the front wall that has a third height, and wherein the packages have a height that is greater than the third height so that the apertures are elevated above an upper edge of the base portion.

8. The packaged set of articles according to claim 1, wherein the base portion of the container comprises a second portion of the front wall and a second portion of the rear wall, the second portion of the front wall having a third height and the second portion of the rear wall having a fourth height, the third height being greater than the fourth height.

9. The packaged set of articles according to claim 8 wherein the third height of the second portion of the front wall is greater than the first height of the first portion of the front wall.

10. The packaged set of articles according to claim 8 wherein the second height of the first portion of the rear wall is greater than the fourth height of the second portion of the rear wall.

11. The packaged set of articles according to claim 10 wherein the first portion of the rear wall comprises an entirety of the rear wall of the container such that the fourth height is zero.

12. The packaged set of articles according to claim 1, wherein the top portion of the container comprises a first portion of the first sidewall and a first portion of the second sidewall, the first portions of the first and second sidewalls terminating in a concave lower edge.

13. The packaged set of articles according to claim 12 wherein a height of the first portions of the first and second sidewalls measured from the top end of the container to the concave lower edges continuously increases with distance from the front wall to the rear wall.

14. The packaged set of articles according to claim 12, wherein the base portion of the container comprises a second portion of the first sidewall and a second portion of the second sidewall, the second portions of the first and second sidewalls terminating in respective convex upper edges.

15. The packaged set of articles according to claim 14 wherein a height of the second portions of the first and second sidewalls measured from the bottom end of the container to the respective convex upper edges continuously decreases with distance from the front wall to the rear wall.

16. The packaged set of articles according to claim 1, wherein the pre-weakened line is a perforation line that facilitates tearing of the container along the pre-weakened line to separate the top portion from the bottom portion.

17. The packaged set of articles according to claim 1, wherein each of the articles is a toothbrush.

18. The packaged set of articles according to claim 17 wherein each of the toothbrushes are of the same style.

19. The packaged set of articles according to claim 1, wherein each of the plurality of packages has a display side and a non-display side, and wherein the display side of the each of the packages faces the front wall of the container and the non-display side of each of the packages faces the rear wall of the container.

20. The packaged set of articles according to claim 1, wherein the container is alterable between: (1) a closed state in which the top and base portions of the container are coupled together; and (2) an open state in which the top portion of the container is separated from the base portion of the container along the pre-weakened line.

21. The packaged set of articles according to claim 20 wherein in the open state the base portion of the container defines a holding cavity having an open top end and an open rear end.

22. The packaged set of articles according to claim 1, wherein the second height of the first portion of the rear wall is at least 50% of the height of the rear wall.

23. The packaged set of articles according to claim 22 wherein the second height of the first portion of the rear wall is at least 75% of the height of the rear wall.

24. The packaged set of articles according to claim 23 wherein the second height of the first portion of the rear wall is equal to the height of the rear wall such that the first portion of the rear wall forms an entirety of the rear wall.

25. A method of loading packages onto a support member for retail display, the method comprising:

a) tearing a container along a pre-weakened line to at least partially detach a top portion of the container from a base portion of the container, the base portion of the container defining a holding cavity within which a plurality of packages are located, each of the packages containing an article, wherein the top portion of the container comprises an entirety of a top end of the container and a portion of a bottom end of the container and wherein the base portion of the container comprises a majority of the bottom end of the container, and wherein the top portion comprises a tab portion that forms a portion of the bottom end of the container;

b) while the packages remain positioned in the holding cavity, placing the base portion of the container adjacent to the support member so that a hanging aperture of the packages is aligned with a distal end of the support member;

c) moving the base portion of the container in a first direction so that the support member extends through the hanging apertures of each of the packages to support the packages; and d) moving the base portion of the container in a second direction opposite the first direction, thereby removing the packages from the holding cavity and leaving the packages hanging from the support member.

26. The method according to claim 25 wherein the container comprises a front wall and a rear wall opposite the front wall, the packages located within an internal cavity of the container so that a display-side of the packages faces the front wall of the container, and wherein during step b) the display-side of the packages face away from the support member.

27. The method according to claim 26 wherein the top portion of the container comprises a first portion of the front wall and a first portion of the rear wall.

28. The method according to claim 27 wherein the top portion of the container comprises an entirety of the rear wall so that the holding cavity of the base portion has an open rear end.

29. The method according to claim 26 wherein step a) detaches an entirety of the rear wall of the container from the base portion.

* * * * *